US009512373B2

(12) United States Patent
Schacht Hernandez et al.

(10) Patent No.: US 9,512,373 B2
(45) Date of Patent: Dec. 6, 2016

(54) PROCEDURE FOR THE IMPROVEMENT OF HEAVY AND EXTRA-HEAVY CRUDES

(71) Applicant: INSTITUTO MEXICANO DEL PETROLEO, Mexico City (MX)

(72) Inventors: Persi Schacht Hernandez, Mexico City (MX); Felipe de Jesus Ortega Garcia, Mexico City (MX); Jose Manuel Dominguez Esquivel, Mexico City (MX); Elizabeth Mar Juarez, Mexico City (MX); Jesus Ricardo Ramirez Lopez, Mexico City (MX)

(73) Assignee: INSTITUTO MEXICANO DEL PETROLEO, Mexico City (MX)

( * ) Notice: Subject to any disclaimer, the term of this patent is extended or adjusted under 35 U.S.C. 154(b) by 673 days.

(21) Appl. No.: 13/969,861

(22) Filed: Aug. 19, 2013

(65) Prior Publication Data

US 2014/0158584 A1 Jun. 12, 2014

(30) Foreign Application Priority Data

Aug. 20, 2012 (MX) ..... MX/a/2012/009647

(51) Int. Cl.
*C10G 67/02* (2006.01)
*C10G 47/36* (2006.01)
(Continued)

(52) U.S. Cl.
CPC ..... *C10G 67/02* (2013.01); *C10G 33/00* (2013.01); *C10G 33/06* (2013.01); *C10G 33/08* (2013.01); *C10G 47/02* (2013.01); *C10G 47/36* (2013.01); *C10G 49/26* (2013.01); *C10G 2300/1033* (2013.01); *C10G 2400/02* (2013.01); *C10G 2400/04* (2013.01)

(58) Field of Classification Search
CPC ..... C10G 33/00; C10G 33/06; C10G 33/08; C10G 47/26; C10G 47/36; C10G 49/12; C10G 49/22; C10G 49/26; C10G 67/02
See application file for complete search history.

(56) References Cited

U.S. PATENT DOCUMENTS 4,077,867 A 3/1978 Aldridge et al.
4,134,825 A 1/1979 Bearden, Jr. et al.
(Continued)

FOREIGN PATENT DOCUMENTS

CA 1264726 1/1990
WO 2013/126364 8/2013

OTHER PUBLICATIONS

Absi-Halabi, M. et al., Coke formation on catalysts during the hydroprocessing of heavy oils, Applied Catalysis, 1991, vol. 72, Issue 2, pp. 193-215 (Abstract).
(Continued)

*Primary Examiner* — Renee E Robinson
(74) *Attorney, Agent, or Firm* — Dickinson Wright PLLC

(57) ABSTRACT

The physical and chemical properties of heavy and extra-heavy crudes are improved by a procedure that uses a homogeneous type catalyst and involves the stages: 1. separation and removal of the water fraction that is contained in the hydrocarbons, 2. catalyst injection and activation of the reaction system, 3. elimination of gaseous hydrocarbons and recovery of the partial pressure of hydrogen at different times, 4. reaction and 5. recovery of distilled products.

15 Claims, 1 Drawing Sheet

(51) Int. Cl.

| | |
|---|---|
| ***C10G 49/26*** | (2006.01) |
| ***C10G 33/06*** | (2006.01) |
| ***C10G 33/08*** | (2006.01) |
| ***C10G 33/00*** | (2006.01) |
| ***C10G 47/02*** | (2006.01) |

(56) References Cited

U.S. PATENT DOCUMENTS

| | | | | | |
|---|---|---|---|---|---|
| 4,136,013 | A | | 1/1979 | Moll et al. | |
| 4,411,771 | A | * | 10/1983 | Bambrick | B01J 21/04 208/112 |
| 4,486,293 | A | | 12/1984 | Garg | |
| 4,652,545 | A | | 3/1987 | Lindsley et al. | |
| 5,168,088 | A | | 12/1992 | Utz et al. | |
| 5,269,909 | A | | 12/1993 | Ovalles et al. | |
| 5,731,101 | A | | 3/1998 | Sherif et al. | |
| 5,891,829 | A | | 4/1999 | Vallejos et al. | |
| 5,914,030 | A | * | 6/1999 | Bearden | C10G 45/16 208/189 |
| 6,139,723 | A | | 10/2000 | Pelrine et al. | |
| 6,405,799 | B1 | | 6/2002 | Vallejos et al. | |
| 6,547,957 | B1 | * | 4/2003 | Sudhakar | C10G 45/16 208/111.01 |
| 6,969,693 | B2 | | 11/2005 | Sauvage et al. | |
| 7,001,504 | B2 | | 2/2006 | Schoonover | |
| 2006/0144756 | A1 | * | 7/2006 | Ackerson | C10G 45/16 208/108 |
| 2010/0116713 | A1 | * | 5/2010 | Ortega Garcia | B01J 23/85 208/121 |
| 2010/0193401 | A1 | * | 8/2010 | Nares Ochoa | B01J 27/053 208/57 |
| 2011/0139262 | A1 | | 6/2011 | Aburto Anell et al. | |

OTHER PUBLICATIONS

Miki, Y. et al., Role of catalyst in hydrocracking of heavy oil, Journal of Catalysis, 1983, vol. 83, Issue 2, pp. 371-383 (Abstract).
McFarlane, R. et al., Dispersion and Activity of Inorganic Catalyst Precursor in Heavy Oil.

* cited by examiner

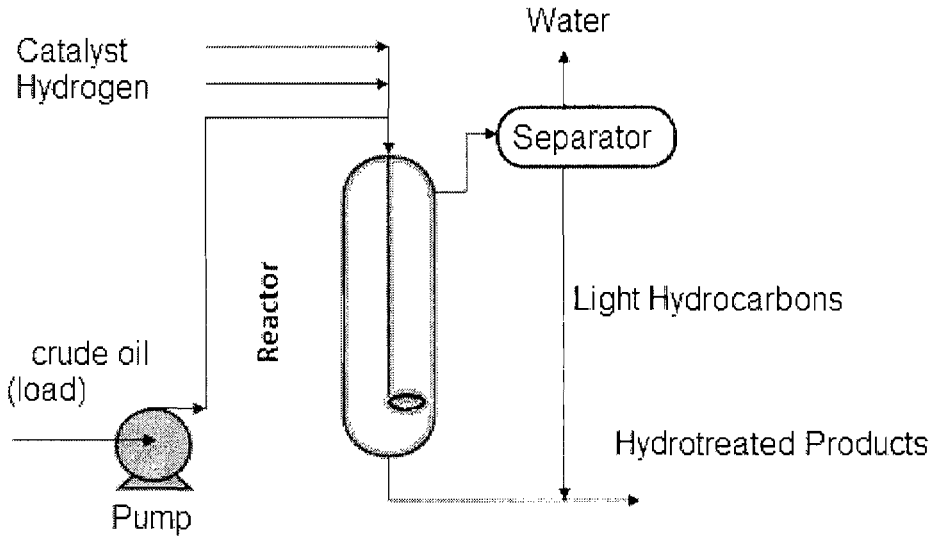
Water
Catalyst
Hydrogen
Separator
Reactor
Light Hydrocarbons
crude oil
(load)
Hydrotreated Products
Pump

PROCEDURE FOR THE IMPROVEMENT OF HEAVY AND EXTRA-HEAVY CRUDES

CROSS-REFERENCE TO RELATED APPLICATION

This application claims the benefit under 35 U.S.C. §119 of Mexican Patent Application No. MX/a/2012/009647 filed Aug. 20, 2012, which is hereby incorporated by reference in its entirety.

FIELD OF THE INVENTION

The present invention belongs to the field of technologies for improving in situ physical and chemical properties of heavy and extra-heavy crude oils. Specifically, it deals with reduction of viscosity, density, sulfur contents and metals contents in the oils at the production platform level, in order to increase its fluidity, rate of recovery, production as well as commercial value.

This invention relates to a procedure for the application of a catalyst in homogeneous phase, which allows the transformation of heavy and extra-heavy crude oils into lighter crudes, by means of procedures here described, which allow to improve the physical and chemical properties of those hydrocarbons, thus its kinematic viscosity decreases, API gravity increases, and other changes occur on the composition of families of those hydrocarbons, i.e. SARA (Saturates, Aromatics, Resins and Asphaltenes), thus increasing the proportion of saturated and aromatics, while decreasing the resins and Asphaltenes fractions; likewise, these procedures reduce the content of sulfur and nitrogen associated to those crudes, which afford best performance and higher commercial value for obtaining distillates, with a better selectivity to gasoline, diesel and fuel oils, which represents a higher proportion of light crude oil.

BACKGROUND

In the next years to come one of the untapped natural energy sources will be made mainly by heavy crude oil; this implies that the petroleum industry will require more efficient secondary and tertiary recovery processes, thus this concept fuels the development and application of new alternatives for increasing the productivity by production site as well as development of new methods for improving the transport of the heavy crudes to refining centers. These aspects are relevant aspects in the oil industry, both for maintaining acceptable levels of production to meet the commitments of refining and hydrocarbons exports. However, heavy crude oil deposits are difficult to exploit, because of the high resistance to flow (i.e., high viscosity) and poor performance of distillable fraction (i.e., <538° C.); in addition, there exist price penalties for high concentration of contaminants and moisture, which reduce the profit margins.

Currently, there are some technologies that are used to improve the quality of the heavy and extra-heavy crudes within the production site, with the purpose of increasing the recovery factor; among the most important are steam the injection, cyclic steam injection, aquatermolysis, drained of steam by assisted gravity (SAGD), air injection, Toe-to-Heel Air Injection (THAI), conventional in-situ combustion and combustion in situ through intelligent wells. On the other hand, conventional crudes, i.e., with 20 to 32° API, are extracted from the production site by artificial systems of production, sometimes using primary and secondary recovery methods. However, in the case of the heavy crudes, i.e., with about 10-15° API, its extraction is complex, even more the improvement of their recovery factor, by using conventional techniques currently in application; thus, the use of more complex schemes are the logical choice, especially for increasing the recovery factor and to comply the crude quality requirements required in the exportation contracts, in the medium and long term.

However, the current technologies present serious limitations. For example, In the case of the steam injection assisted by gravity drainage (SAGD) and the cyclic steam stimulation processes (CSS), these can be applied only to shallow formations, i.e., no more than 1,000 m. All the air-injection technologies present the disadvantage of higher risks, because the injection of air starts an ignition fire in the site, which provokes a combustion front that moves from the injector well to the producer well, usually; however, during this process there are serious explosion risks, as well as the risk of diversion of the combustion front, which may extinguish the flame of the front of combustion before reaching the hydrocarbons deposit.

The THAI/CAPRI technology uses a vertical injection well that is combined with a horizontal production well, instead of only vertical wells. Thus, it consists of lighting a fire on-site, which is fed along with air from the well surface, by means of a vertical shaft. The air pressure makes it that the combustion chamber grows and develops a great amount of heat in the site. The heat reduces the viscosity of the heavy crude, which tends to flow easy towards a horizontal production well. The gas produced from the combustion pushes some crude oil fraction up to the surface.

The THAI process combines a special configuration of vertical and horizontal well with combustion in situ. CAPRI means that a catalyst is added to the gravel filling around the production well. The idea that underpins THAI/CAPRI is to start an underground fire as explained above, thus creating bitumen flow and, at the same time, improve the crude oil API gravity, before it leaves the ground.

Data from some patents related to the matter of improvement of both physical and chemical properties of heavy oils, with type of catalyst and precursors used for, are provided here below.

U.S. Pat. No. 7,001,504 refers to the use of a ionic composition in liquid phase, for the extraction of organic sulfur compounds that can be extracted by direct or partial oxidation of the sulfur compounds to sulfoxides or sulfones, in order to increase its solubility in the liquid phase Ionic composition and not, as in the present invention, using a liquid phase ionic catalyst in the presence of hydrogen, which intends to promote hydrocracking and hydrogenation type reactions.

U.S. Pat. No. 6,969,693 refers to the use of liquid phase ionic composition which is immobilized on a support for preparing a catalyst for promoting Friedel Crafts type reactions, especially for alkylation reactions, in contrast with the present invention that proposes the use of a liquid phase ionic composition catalyst in a highly dispersed form to promote hydrocarbons reactions of hydrocracking and hydrogenation.

U.S. Pat. No. 5,731,101 refers to the use of liquid phase ionic composition formed by metal halide and hydro-halogen-alkyl-amine, for the production of linear alkylbenzene, in contrast with the present invention that proposes the use of a liquid phase ionic composition catalyst in a highly dispersed form, which is iron-free, to promote hydrocarbons reactions of hydrocracking and hydrogenation.

U.S. Pat. No. 6,139,723 refers to use of liquid phase ionic composition based on certain assumptions for its application in bitumen and waste.

U.S. Pat. No. 4,136,013 refers to a catalyst in a homogenized suspension of Fe, Ti, Ni and V for crude oil and residue hydrogenation reactions.

U.S. Pat. No. 4,077,867 and U.S. Pat. No. 4,134,825 refers to the hydroconversion of coke and heavy crude oil with catalysts based on Mo naphthenates, which is not the main scope of present invention.

U.S. Pat. No. 4,486,293 used a catalyst in combination with a metal Group VI B or group B VIII from organic salts of these metals for applying in to the liquefaction of Coke, together with a hydrogen donor salt in aqueous solution. However, the catalyst is firstly soaked in coke prior to the liquefaction reaction, and it does not proceed with the liquid phase ionic composition catalyst prepared with inorganic salts of iron and molybdenum, which are dispersed in the crude oil and are not impregnated.

U.S. Pat. No. 5,168,088 refers to the use of a catalyst in slurry fluid for the liquefaction of coke through the precipitation of iron oxide in the matrix of Coke; it differs from liquid phase Ionic catalyst composition prepared on the basis of inorganic salts of iron and molybdenum that are dispersed in the oil and which do not precipitate.

SUMMARY OF THE INVENTION

A process has been found for improving the properties of heavy and extra-heavy crude oils "in-situ" by means of a catalytic reaction with a liquid phase ionic composition of a Ni—Mo catalyst, which is injected in the homogeneous phase to the crude oil feed, in such a way to cause the transformation of the physical and chemical properties of such heavy crude oil, i.e., API gravity, viscosity and fraction composition, to result in a lighter crude. More specifically, this invention refers to a procedure that consists of a series of stages during the application of the homogeneous catalytic process.

According to one aspect, the present invention provides a procedure to improve the properties of heavy and extra-heavy crude oils by a two-stage reaction. Likewise, the provided procedure is performed with strict control of operating conditions such as temperature, pressure and time, which allow obtaining hydrocarbons with improved properties with respect to initial oil.

According to another aspect of the invention, heavy and extra-heavy crudes are improved by a procedure that uses a homogeneous catalyst and involves the stages: 1. separation and removal of the water fraction that is contained in the hydrocarbon feed by a pressure release, 2. catalyst injection and activation of the reaction system, 3. Venting of the reactor to eliminate gaseous hydrocarbons by pressure release followed by addition of hydrogen to recover the hydrogen partial pressure at different times, 4. reaction, preferably with pressure release at intervals to inhibit coke formation, and 5. recovery of distillated products. The physical and chemical properties of heavy crude oils are improved by increasing API gravity, decreasing kinematic viscosity, changing fraction composition (SARA), thus increasing the proportion of saturated and aromatic fractions, while and decreasing the resins and asphaltene contents, in such a way that the hydrotreated crude oil becomes much lighter. The sulfur and nitrogen content is reduced, which overall results in a greater yield of distillates, with higher commercial value, while the coal produced during the reaction is less than 1 wt. %.

BRIEF DESCRIPTION OF THE DRAWINGS

FIG. 1 illustrates the process diagram for hydrocracking/hydrogenation reactions of heavy and extra heavy crude oils, in two steps. In the first stage the moisture present in the hydrocarbon is removed, then the product of this stage is fed to the reactor where the hydrocracking/hydrogenation reactions take place.

DETAILED DESCRIPTION OF THE INVENTION

The present invention relates to a procedure for the application of a catalyst in homogeneous phase, which affords the transformation of heavy and extra-heavy crudes into lighter crudes, which allows improvement of the physical and chemical properties of those hydrocarbons, i.e., a. decrease of its kinematic viscosity, the increase of API gravity, compositional changes of hydrocarbons (SARA), thus increasing the proportion of saturated and aromatics, while decreasing the resins and Asphaltene proportion; likewise, the contents of sulfur and nitrogen are reduced, which gives a better performance and higher commercial value for distillates, while improving selectivity towards gasoline, diesel, and fuel oils, mainly, thus resulting in a much lighter crude, globally.

The procedure consists of the following stages: The first stage involves separation and removal of the water contained in the hydrocarbon feed, which may be a heavy crude oil and/or extra heavy crude oil, as these terms are conventionally used in the oil industry. The second stage involves catalyst injection and activation of the reaction system. As indicated, a liquid phase catalyst is injected into the reactor. Suitable catalysts include liquid phase ionic compositions with metals from Group VI B and Group VIII B of the periodic table, which catalysts are highly miscible in hydrocarbons and are in a homogeneous phase. Such catalysts are disclosed for in Mexican Patent MX290557 granted Sep. 27, 2011 to Schacht Hernandez et al, based on Application Serial No. MX/a/2008/006051, the disclosure of which is hereby incorporated by reference in its entirety. The preferred catalyst is Ni—Mo. Activation of the system involves preparing the reaction system to initiate the reaction state, as hereinafter described.

The third stage involves elimination of excess gaseous hydrocarbons at intervals and recovering the pressure in the reactor by feeding hydrogen using the hydrogen partial pressure at different times. Thus, for example, at 10 to 30 minute intervals, preferably 12 to 20 minute intervals, especially 15 minute intervals, light hydrocarbon gases are vented from the reactor until the pressure drops 50 kg/cm$^2$. Hydrogen is then injected into the reactor to recover the pressure until the desired pressure, for example, 100 kg/cm$^2$ is achieved. Suitable conditions for the forth stage involves carrying out the reaction. Suitable pressures for reaction include a pressure of 80 to 120 Kg/cm$^2$, preferably a pressure in the range of 90 to 110 Kg/cm$^2$, with a pressure of 100 Kg/cm$^2$ being especially preferred. A reaction temperature may be between 350 to 450° C., preferably 375 to 425° C., with 390° C. being especially preferred. During the course of the reaction, a number of exhausts, such as 1 to 4, preferably 1-3, especially two exhausts may be made in which the pressure is reduced 40 to 60%, preferably about 50% of the operating pressure for each exhaust. For example, if the reaction pressure is 100 Kg/cm$^2$, the exhaust or venting may be made until reaching a pressure of 50% of such reaction pressure, i.e., 50 Kg/cm$^2$. Then, in order to optimize the reaction pressure setting, the pressure in the reactor is adjusted again back to operating pressure by addition of hydrogen, for example, to the operating pressure of 100 Kg/cm$^2$. This procedure avoids generation of carbon or coke and optimizes production of liquid products. The reaction is conducted for 1 to 4 h, preferably 1 to 3 h, with 2 h being especially preferred. The fifth stage involves recovery of the distillate products.

FIG. 1 shows the general scheme of the process for improvement of the heavy and extra-heavy crudes. A scheme for the integrated process is listed below:

First, a load of crude is put into the reactor, as for example, 200 g, which is then pressed with nitrogen to check its tightness; after about 20 minutes the nitrogen is replaced by hydrogen. A temperature ramp is set at a rate of about 20° C./min. After reaching a temperature of 120° C., the reactor is aligned as to have the outlet valve in position; at this stage the water is removed and the light gaseous hydrocarbons are also removed within the temperature of 190-350° C., preferably 225-300° C. with a temperature of 250° C. being especially preferred; a pressure of about 30-80 Kg/cm$^2$, preferably 40 to 65 Kg/cm$^2$, with 50 Kg/cm$^2$ being especially preferred, for a time interval of 15 to 70 min, preferably 20 to 40 min., with 30 min. being especially preferred. The light hydrocarbons are separated from water for their subsequent reintegration to the final product. In the second stage the reactor is cooled down to 50° C., for injecting the liquid phase catalyst into the reactor, in a proportion of about 1 to 10% wt, preferably at 4% with respect to the oil load. The catalyst is mixed with the oil using mechanical stirring at about 800 RPM. The reactor outlet valve is then closed and the pressure increased for operation to a pressure of 80 to 120 Kg/cm$^2$, preferably a pressure in the range of 90 to 110 Kg/cm$^2$, with a pressure of 100 Kg/cm$^2$ being especially preferred. The reaction temperature is set between 350 to 450° C., preferably 375 to 425° C., with 390° C. being especially preferred, at a rate of, for example, 10° C./min.

During the course of the reaction, two exhausts may be made until reaching a pressure of 50 Kg/cm$^2$. Then, in order to optimize the pressure setting, this is adjusted again at about 100 Kg/cm$^2$, which procedure provides the best reaction performance, thus avoiding the generation of carbon and optimizing the performance of liquid products. The reaction is run for 1 to 4 h, preferably 1 to 3 h, with 2 h being especially preferred, and at the end of the response time, the reactor is cooled down to room temperature and stirring is stopped, for the product recovery; also, the relief is made slowly, to avoid the loss of light hydrocarbons.

At this point the recovered product is ready for physical and chemical analysis, i.e., API gravity, kinematic viscosity, change in the composition of hydrocarbon fractions (SARA: Saturated, Aromatics, Resins and Asphaltenes), also one determines the sulfur and nitrogen content, as well as a simulated distillation.

In the reaction products there is the formation of coke but liquid yield is very high, exceeding 95 wt. %.

The evaluations were carried out according to the diagram in FIG. 1, under operating conditions that prevent the generation of carbon, thus optimizing the performance to liquid products. To this end the operation range is as follows and it is shown in Table 1:

TABLE 1

| Operation conditions | |
|---|---|
| Pressure: | 80-120 Kg/cm$^2$ |
| Temperature: | 380-420° C. |
| Response time: | 0.5-2 h |
| Catalyst concentration: | 5-10% wt |

During the this development it is clear that breakdown of asphaltenic and resins type molecules occur, as well as the removal of compounds like sulfur and nitrogen, while the API gravity of the crude oils rises, and its viscosity is lowered significantly.

With the purpose of showing benchmarks of the non-supported catalysts, a heavy crude oil was reacted together with a liquid phase nickel catalyst composition. The results of the evaluations are shown in examples 1 to 4.

The heavy crude oils used as "the load" and which was used to carry out different experiments, was a heavy crude from the region of Northern Veracruz, Mexico, with properties that are listed in Table 2.

EXAMPLES

Some practical examples of the present invention are following stated for a better understanding, not limiting its scope.

Example 1

In a batch type with a capacity of 500 ml, 200 g of crude oil were placed and homogenized, by mechanical agitation of about 800 rpm. The temperature is raised from room temperature to about 250° C., at a rate of 10° C./min, while keeping open the vent valve, for allowing the water contained in the hydrocarbon to be separated; in the same section the light hydrocarbons to be quantified are transferred and they are subsequently returned for evaluation of the whole hydrotreated product. The second step consists of injecting the 10 g liquid phase catalyst, which is made of nickel and which is dehydrated first, and homogenized perfectly at 800 rpm. The feed of hydrogen is let into the reactor until reaching the pressure of 100 Kg/cm$^2$ in the system, then the temperature increases up to 390° C. at a rate of 10° C./min. Once the stabilized conditions are set, the reaction time is set for about one hour. The first exhaust is carried out after 25 minutes reaction and the second exhaust is set for about 45 minutes after, then some adjustments of the reactor pressure are made at 100 Kg/cm$^2$. After one hour the cooling of the reactor is started, and the hydrotreated crude is recovered, together with the light hydrocarbon fraction, moisture free, that was collected in the first step.

Following the procedure described above for the application of the liquid phase catalyst composition, i.e. homogeneous phase, the physical and chemical properties of the hydrocarbons are determined and verified for improvement, i.e., API gravity increases from 11 to 18°, while kinematic viscosity decreases from about 3979 cSt down to about 153 cSt. Also, the SARA composition shows an increase of the saturated and aromatic hydrocarbons, at the expenses of the resins and Asphaltenes conversion, which decreased from 25% to 19%, and from 23% to 16% wt., respectively. Likewise, the sulfur content diminishes from 5.3 to about 4.4% wt., which means about 17% of removal by weight.

Also, the yield of distillates with higher commercial value increases, i.e., 14% of gasoline, 9% Diesel, 52% diesel fuel, that is a total of 75% distillates.

Example 2

In a batch reactor with a capacity of 500 ml, 200 g of crude oil were placed and homogenized, with mechanical agitation of 800 rpm. The temperature is increased up to 250° C. at a rate of 10° C./min, while keeping the exhaust valve open, in such a way that it allows that the water contained in the hydrocarbon is sent to the separation section; at the same time, the light hydrocarbons are transferred and quantified, which returns to the reactor for the final evaluation of the hydrotreated product subsequently. The second step consists of injecting to the dehydrated crude 10 g of liquid phase catalyst, which is a composition containing nickel, then it is homogenized perfectly at 800 rpm. Following this procedure, the hydrogen is fed, reaching a pressure of about 100 Kg/cm$^2$ in the system; at this point the temperature is increased up to 400° C. at a rate of 10° C./min. Once the conditions are stable the reaction proceeds for about one hour. The first exhaust was carried out 25 min after the reaction, while the second exhaust occurs 45 min later; then, the reactor pressure is reset at 100 Kg/cm$^2$. After one hour the cooling of the reactor starts and after this the hydrotreated crude is recovered together with the returned light fraction that is free of moisture, which was collected during the first stage.

Following the procedure described above with the application of the homogeneous phase catalyst, the physical and chemical properties of the resulting hydrocarbons are evaluated, i.e., API gravity changes from 11 to 20°, while kinematic viscosity decreases from 3979 down to 85 cSt. Also, the composition of hydrocarbons fractions (SARA) is modified, in such a way that saturated and aromatic hydrocarbons increase at the expense of resins and Asphaltenes conversion, which fell from 25% to 18% and 23% to 14% wt., respectively. Likewise, the sulfur contents diminishes from 5.3 to 4.7% wt, which implies a net removal of 11% wt. approximately.

This procedure allows to increase the yield of distillates of higher commercial value, by 13% gasoline, 11% Diesel, 54% diesel fuel, i.e., a total of 78% distillates.

Example 3

In a batch reactor with a capacity of 500 ml, 200 g of crude oil were placed and are homogenized, with mechanical agitation of about 800 rpm. The temperature is increased up to 250° C. at a rate of 10° C./min, while keeping open the vent valve, in such a way that it allows that the water contained in the hydrocarbons passes to separation stage as well as the light hydrocarbons to be quantified later and which return to the final hydrotreated product subsequently. The second step consists of injecting to the dehydrated crude 10 g of the liquid phase catalyst, which is a composition containing nickel; this is homogenized perfectly at 800 rpm. Then, hydrogen is fed, reaching a pressure of about 100 Kg/cm$^2$ in the system, with an increase of the temperature to about 390° C., at a rate of 10° C./min. Once the conditions stabilize, the reaction is left to run for 30 min. The first exhaust valve is open after 15 min after and the second is open 30 min later; then, the reactor pressure is reset at 100 Kg/cm$^2$. At the end of two hours the cooling of the reactor starts and the hydrotreated crude is recovered, together with the light hydrocarbon fraction, moisture free, that was collected in the first stage.

Following the procedure as described above, with the application of the liquid phase catalyst, the physical and chemical properties of the resulting hydrocarbons are evaluated to verify some improvement, i.e., API gravity changes from 11 to 20°, while kinematic viscosity decreases from 3979 down to 62 cSt. The composition of the hydrocarbon fractions (SARA) shows an increase of the saturated and aromatics, at the expense of the resins and Asphaltenes conversion, which decrease from 25% to 17% and 23% to 11% wt., respectively. Likewise, sulfur content changes from 5.3% wt. to 4.1% wt., which is a removal of about 22% wt. approximately.

Therefore, this procedure allows to increase the yield of distillates of higher commercial value, by 16% gasoline, 22% Diesel, 47% diesel fuel, i.e., a total of 85% distillates.

Example 4

In a batch type reactor with a capacity of 500 ml, 200 g of crude oil were placed and homogenized, with mechanical agitation of about 800 rpm. The temperature is increased up to 250° C. at a rate of 10° C./min, while keeping open the vent valve, in such a way that it allows that the water contained in the hydrocarbon be sent for separation; in the same stage the light hydrocarbons are transferred and these are kept for posterior evaluation once returned to the final hydrotreated product. The second step is to inject to the dehydrated crude oil 10 g of liquid phase catalyst made with nickel, which is homogenized by stirring at 800 rpm. Afterwards hydrogen is fed, reaching a pressure of 100 Kg/cm$^2$, then the temperature is increased at 380° C. at a rate of 10° C./min. Once conditions are stabilized, the reaction is left for about one hour. The first exhaust was carried out 45 min later while the second exhaust happens at about 60 min, with a reactor pressure of about 100 Kg/cm$^2$. After one hour the cooling of the reactor starts, then the hydrotreated crude is recovered, while the light gas fraction, which was diverted at the first stage and which is moisture free, returns to the reactor for evaluation. Following the procedure described above for the application of the catalyst in homogeneous phase, the physical and chemical properties of the hydrocarbons were determined for verifying some improvements, i.e., API gravity that increases from 11 to 20 degrees, while kinematic viscosity decreases from 3979 down to 62 cSt. Also, the composition of hydrocarbon fractions (SARA) shows an increase of the saturated and aromatic fractions, at the expense of the resins and Asphaltenes conversion, which decreased from 25% to 17% and from 23% to 11% wt., respectively. Likewise, the sulfur contents diminishes from 5.3% wt. to 4.1% wt., which corresponds to a 22% wt. removal.

TABLE 2

Physical and chemical properties of the original and hydrotreated heavy crudes.

| Properties | Crude Oil | Example 1 | Example 2 | Example 3 | Example 4 |
|---|---|---|---|---|---|
| Specific gravity, ° API | 11.0 | 18 | 20 | 20 | 20 |
| Viscosity, T = 37.8° C. | 3979 | 153 | 85 | 62 | 84 |

TABLE 2-continued

Physical and chemical properties of the original and hydrotreated heavy crudes.

| Properties | | Crude Oil | Example 1 | Example 2 | Example 3 | Example 4 |
|---|---|---|---|---|---|---|
| (cSt) | T = 54.4° C. | 1407 | 42 | 52 | 35 | 50 |
| | T = 70° C. | 489 | 18 | 35 | 21 | 33 |
| Total sulfur, % wt | | 5.3 | 4.4 | 4.7 | 4.1 | 4.4 |
| Nitrogen (total), ppm wt. | | 4994 | 4751 | 4070 | 4689 | 4945 |
| Coal, % wt. | | — | 0.4 | 0.6 | 0.3 | 0.2 |
| SARA, wt. % | Saturated | 16 | 26 | 27 | 34 | 18 |
| | Polar | 25 | 19 | 18 | 17 | 27 |
| | Aromatics | 36 | 39 | 41 | 38 | 42 |
| | Asphaltenes | 23 | 16 | 14 | 11 | 18 |
| ° C. distillation 7169 ASTM | | | | | | |
| TIE | | 32 | 127 | 168 | 132 | 96 |
| 5/10 | | 186/266 | 251/293 | 248/285 | 184/218 | 155/197 |
| 20/30 | | 329/399 | 324/404 | 338/385 | 262/298 | 255/300 |
| 40/50 | | 451/517 | 450/498 | 429/474 | 333/369 | 343/386 |
| 60/70 | | 570/594 | 543/582 | 520/565 | 409/453 | 434/490 |
| 80/90/95 | | 627/673/717 | 626/682/711 | 613/670/705 | 506/572/617 | 642-557-694 |
| TFE | | 1018 | 742 | 34° | 713 | 34° |

Therefore, a greater yield of distillates with higher commercial value was obtained by the procedure here outlined, i.e., 16% gasoline, 22% Diesel, 47% diesel fuel; that is a total of about 85% distillates.

Table 2 shows the viscosities of the original crude oils and hydrotreated product; as observed, the viscosity of the crude oil decreased considerably while its API gravity increased from about 11 to about 20°. The carbon content was 0.5 wt. %.

What is claimed is:

1. A process for the transformation of a heavy and/or extra-heavy crude oil feed into a lighter crude oil, which comprises providing a hydrocarbon feedstock including said crude oil feed to a reaction zone of a reactor, and conducting the following stages comprising a) separating and removing water from said crude oil feed, b) injecting a liquid phase ionic catalyst into said reaction zone and activating said reaction zone, c) venting said reaction zone to remove gaseous hydrocarbons and introducing hydrogen to said reaction zone to recover partial hydrogen pressure at predetermined intervals, d) reacting said hydrocarbon feedstock under hydrotreating conditions in the reaction zone of the reactor, and e) recovering distillated products.

2. The process of claim 1, wherein moisture and light hydrocarbons are removed in stage a) at a pressure in the range of 30 to 80 kg/cm$^2$, a temperature in the range of 190-350° C. and a reaction time in the range of 10 to 40 minutes.

3. The process of claim 1, wherein said liquid phase ionic catalyst is a liquid phase nickel catalyst injected into the reactor in a ratio of 5 to 10 wt. % based on crude oil feed.

4. The process of claim 1, wherein a carbon residue content of the light crude oil product is less than 1 wt. %.

5. The process of claim 1, wherein a reaction time in step d) is in the range of 0.5 to 2 hours.

6. The process of claim 1 wherein said reaction produces about 40 to 60% of distillates, selected from the group consisting of gasoline, diesel and fuel oil, said distillates being produced by cracking of resins and asphaltenes.

7. The process of claim 1, wherein said reactor is a hydrotreating reactor and resulting light products are recovered after return to the hydrotreating reactor.

8. The process of claim 1, wherein activation is at a pressure in the range of 80 to 120 kg/cm$^2$, a temperature in the range 350 to 450° C. and a reaction time of from about 0.5 to 4 h.

9. The process of claim 1, wherein said process results in the generation of about 1% wt. coal.

10. The process of claim 1, wherein said reaction in stage d) is conducted at a reaction pressure of 90 to 110 Kg/cm$^2$, a reaction temperature 375 to 425° C., for a period of 1 to 3 hours, and during said reaction 1 to 4 exhausts are made to reduce the pressure in the reaction zone to about 40 to 60% of the reaction pressure to inhibit coke formation with each exhaust followed by repressuring the reaction zone by injecting hydrogen to said reaction pressure.

11. The process of claim 10, wherein the pressure is reduced to about half of the reaction pressure in the reaction zone during each exhaust.

12. The process of claim 1, where said liquid phase ionic catalyst is a homogenous phase comprising at least one metal selected from the group consisting of Group VIB metals, Group VIIIB metals and mixtures thereof.

13. The process of claim 1, wherein said liquid phase ionic catalyst includes Mo and Ni.

14. A process for converting heavy and/or extra-heavy crude oil feed into a lighter crude oil, reducing density and reducing a sulfur and metal content of the crude oil, said process comprising a) supplying said crude oil feed to a reaction zone of a reactor and separating and removing water from said crude oil feed and said reactor, b) injecting a homogenous liquid phase catalyst containing a nickel catalyst into said reaction zone in an amount of 5 to 10 wt. % based on the amount of said crude oil, and activating said reaction zone, c) venting said reaction zone to remove gaseous hydrocarbons and introducing hydrogen to recover a partial hydrogen pressure to a predetermined level, d) reacting said hydrocarbon feedstock under hydrotreating conditions at a temperature of 190 to 350° C. and pressure of 30 to 80 $Kg/cm^2$ to obtain hydrotreated reaction products having a reduced density and increased API gravity, and e) recovering distillated products having an increased API gravity, reduced sulfur content and reduced metal content relative to said crude oil feed.

15. The process of claim 14, wherein a light hydrocarbon fraction is removed from said reactor with water at a temperature of 190 to 350° C. and pressure of 30-80 Kg·cm2; separating the light hydrocarbon fraction from the water, and combining the light hydrocarbon fraction to said hydrotreated reaction products.

* * * * *